United States Patent [19]

Babcock

[11] 4,372,697

[45] Feb. 8, 1983

[54] RIBBON DRIVE ARRANGEMENT FOR A PRINTER

[75] Inventor: David H. Babcock, Lexington, Ky.

[73] Assignee: International Business Machines Corporation, Armonk, N.Y.

[21] Appl. No.: 276,285

[22] Filed: Jun. 22, 1981

[51] Int. Cl.[3] ..... B41J 33/14

[52] U.S. Cl. ..... 400/232; 242/67.5

[58] Field of Search ..... 400/223, 225, 232, 235, 400/236; 242/67.5, 67.4, 67.1 R

[56] References Cited

U.S. PATENT DOCUMENTS

| | | | |
|---|---|---|---|
| 3,349,887 | 10/1967 | Goff, Jr. | 400/232 X |
| 3,548,994 | 12/1970 | Hudson | 400/232 X |
| 3,604,549 | 9/1971 | Caudill | 400/232 |
| 3,677,486 | 7/1972 | Findlay | 242/67.4 |
| 3,899,065 | 8/1975 | Brignole | 400/232 |
| 3,923,141 | 12/1975 | Hengelhaupt | 400/232 |
| 4,168,127 | 9/1979 | Hengelhaupt | 400/232 |
| 4,260,271 | 4/1981 | Kondur, Jr. | 400/232 |

*Primary Examiner*—E. H. Eickholt

*Attorney, Agent, or Firm*—George E. Grosser; John A. Brady

[57] ABSTRACT

Apparatus for advancing equal increments of tape to a takeup reel utilizes a drive blade having an edge that tends to slip in one longitudinal direction and grip in the other. Reciprocation of the drive blade at the circumference of the accumulated tape results in incremental tape movements in the direction corresponding to gripping of the drive edge. For a preferred implementation, the drive edge has the contour of an involute. By so contouring the drive blade, the engagement at the tape circumference is essentially tangential for a broad range of diameters of the accumulated tape.

15 Claims, 4 Drawing Figures

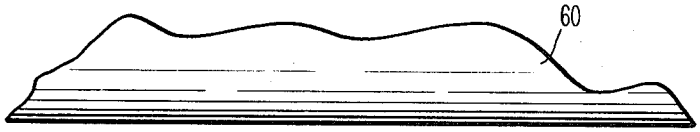
FIG. 3
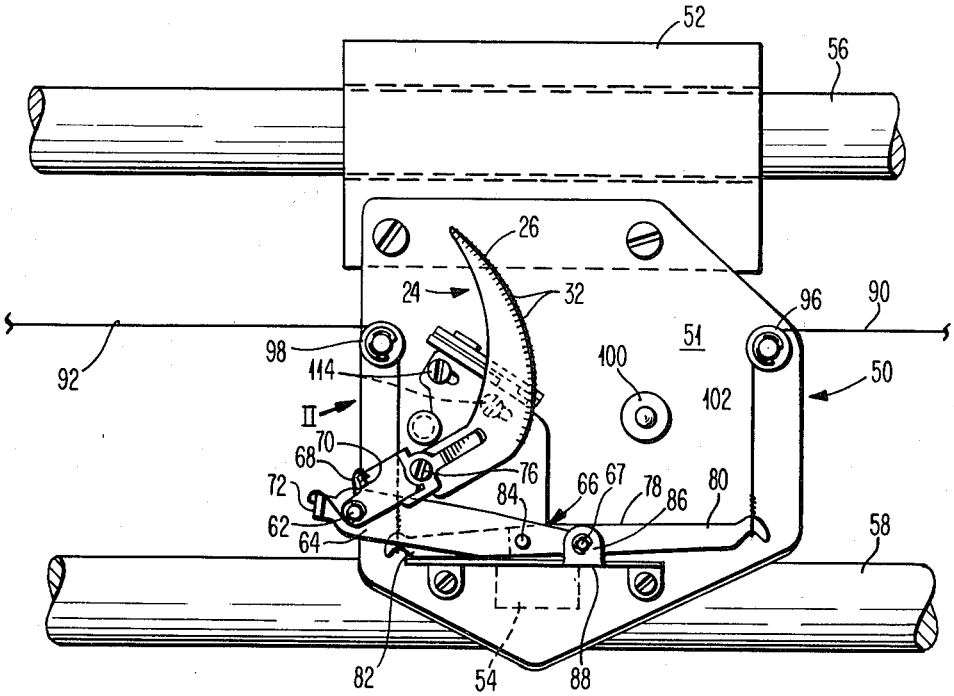
FIG. 4
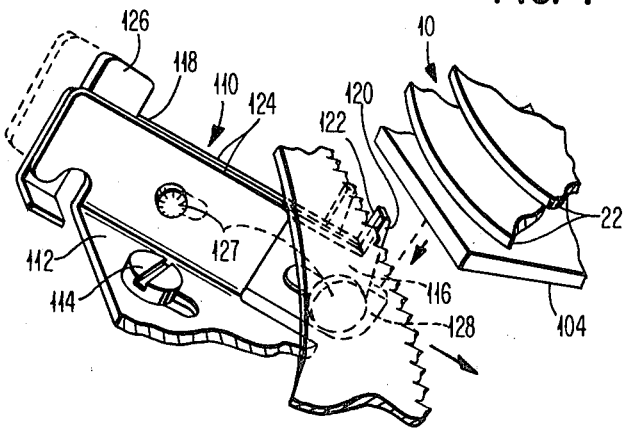

RIBBON DRIVE ARRANGEMENT FOR A PRINTER

BACKGROUND OF THE INVENTION

TECHNICAL FIELD

The subject invention relates to ribbon advancing apparatus and more specifically to compact apparatus for advancing equal increments of a ribbon or tape irrespective of the outer diameter of the ribbon accumulated at a takeup reel.

STATEMENT REGARDING THE ART

In advancing a printing or lift-off ribbon, it is usually desirable to advance equal increments irrespective of the diameter of the ribbon collected on the takeup reel. If, however, the drive motion is applied to a flange or shaft of the takeup reel, as is usually expedient, the increment of advance will change with the diameter of the spooled ribbon. To overcome this problem, it is known to position a "spiked wheel" driver in direct engagement with the ribbon outer circumference at a takeup reel to achieve uniform increments (see, e.g. U.S. Pat. Nos. 3,604,549 and 3,349,887). But for such an arrangement, it generally proves desirable to eliminate or abbreviate flanges on the reel to permit access, particularly, if a narrow ribbon is being incremented for a wide range of diameters.

A known way to provide for equal increments while nonetheless retaining flanges to assure planar wrapping (i.e. no relative shifting to a cone shape) involves a detection of the diameter of the takeup spool and direct drive of the spool at, for example, the reel rim or core in increments corresponding to the detected diameter (see, e.g. U.S. Pat. Nos. 3,677,486 and 4,168,127). Such a feedback approach involves considerable complexity, however. In view of the complexity of advancing a ribbon in equal increments, the often used residual solution is to use a takeup reel with flanges and set the increment to be adequate for the minimum takeup reel diameter. A degree of waste is then tolerated at other diameters.

BRIEF DESCRIPTION OF THE INVENTION

To permit equal increments of ribbon advance while nonetheless using a flanged spool, a reciprocating ribbon drive utilizes a specially shaped drive blade that engages the outer convolution of the spooled ribbon. The blade, preferably, has a drive edge in the shape of an involute of a generating circle and is pivoted about a point corresponding essentially to the generating circles center. A biasing device such as a spring urges the blade about the pivot in a direction with the drive edge leading to cause engagement with the circumference of the spooled ribbon.

The pivot axis for the drive blade is oriented to permit movement in a plane that is generally intermediate the reel flanges and the spool axis is spaced a fixed distance from the pivot axis of the drive blade.

By so arranging the drive blade and takeup reel, it results that the specially shaped blade engages the periphery of the spooled ribbon tangentially for all diameters. The contact point, furthermore, tends to occur along a line through the reel axis that is tangent to the generating circle for the drive blade and a reciprocation of the blade pivot axis along a path generally perpendicular to this line results in a drive motion tangential to the ribbon circumference. Such tangential motion provides an advance increment in a fixed proportion to the reciprocation distance irrespective of ribbon diameter.

By adding directional barbs to the blade, this motion is positively transmitted to the ribbon for a single rotational direction of the reel and with the barbs pointed in the direction of increasing involute radius, a jamming action at the circumference eliminates slippage in the drive direction. To prevent reverse rotation of the spooled ribbon when the drive blade is returning to "start" position, a clutch device is preferably applied to the flange of the spool.

To facilitate initial positioning of the drive blade, a latch is preferably provided that interacts with a structure associated with the takeup reel (e.g. a reel housing) as mounting occurs to trigger a release of the blade to an operative position.

BRIEF DESCRIPTION OF THE DRAWINGS

The subject invention is described in detail below with reference to the drawings wherein:

FIG. 3 is a plan view of a presently preferred implementation of the invention without the takeup reel mounted;

FIG. 4 is a cutaway perspective view emphasizing a latch for a drive blade according to the invention;

DETAILED DESCRIPTION OF A PRESENTLY PREFERRED IMPLEMENTATION OF THE INVENTION

Figure 1:
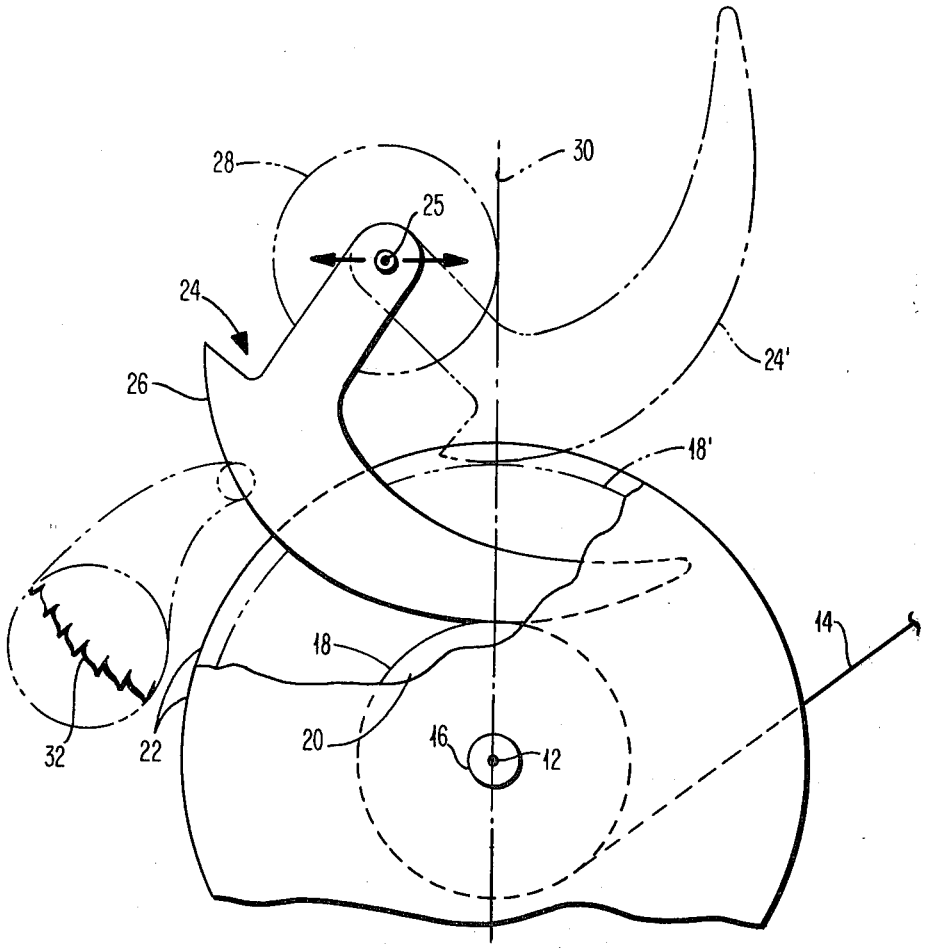
FIG. 1 is a simplified diagram helpful in discussing geometric relationships significant to the subject invention.

Referring to FIG. 1, a takeup reel 10 is arranged to rotate about an axis 12. For rotation in a forward direction (indicated by an arrow), a ribbon 14 is advanced from a supply (not shown) and wraps around a core 16 to build up cylinder 20 of wrapped ribbon with an outer circumference 18. Planarity of the wrapped ribbon cylinder 20 is preferably maintained by two reel flanges 22 that are perpendicular to the axis 12.

A drive blade 24, for driving the takeup reel 10, is according to the invention pivoted to rotate about an axis 25 that is parallel to the takeup reel axis 12. The drive blade 24 according to the invention includes a drive edge 26 that has the shape of an involute of a generating circle, e.g. the circle 28 indicated in phantom. For convenient visualization, an involute curve may be thought of as the locus of the end point of a tape that is peeled from the generating circle by pulling radially.

A special characteristic deriving from the above described geometry involves engagement of the drive blade 24 with the ribbon outer circumference 18. For various diameters of the outer circumference 18 (see also the illustration in phantom), engagement with the drive blade 24 will be tangential and the engagement point will occur along a line 30 that passes through the axis 12 and is tangential to the generating circle 28. This, of course, assumes the drive blade 24 moves in a plane parallel to and between the flanges 22 (see FIG. 2).

To transfer motion, the drive edge 26 is serrated or textured to have projections 32 that are preferably asymmetrical like a sawtooth to have a tendency to "dig in" for relative motion in one direction—the direction of increasing involute radius which is consequently the direction for ribbon advance. The drive blade 24 is biased, as is discussed more fully below, to rotate about the axis 25 in a direction to urge the drive edge 26 into engagement with the outer circumference 18.

By so arranging the drive blade 24, oscillation or vibration of the axis 25 in a direction generally perpendicular to the line 30 translates into an proportional amount of movement of the edge 26 at the circumference 18. For motion in a direction corresponding to advancing movement of the reel 10, the projections 32 cause the engagement point on the outer circumference 18 to move correspondingly. And, this motion is not dependent on the diameter of the circumference 18. As will be discussed below, the axis 25 may be pivoted to achieve, conveniently, a reciprocating motion that is a satisfactory approximation to the desired motion perpendicular to the line 30. During the reverse stroke of the drive blade 24, reverse rotation of reel 10 is preferably prevented by a unidirectional brake 31 (see FIG. 2) which allows the reel 10 to turn in the advance direction only. The brake may, for example, be a simple blade spring 33 that engages the edge of one or both reel flanges 22.

Referring to FIG. 3, a drive blade 24 is arranged on a carrier 50 of a printer (not shown overall) which includes a platform 51 and guide sections 52 and 54 that are recessed to receive and slide along guide rails 56 and 58 which define a carrier path in directions parallel to the longitudinal axis of a platen 60. The drive blade 24 is pivotally mounted by a pin 62 (defining the axis 25) to an arm 64 of a three armed pivot 66 that rotates about a pin 67. By the biasing action of a spring 68 that is compressed between tabs 70 and 72, the drive blade is urged in the clockwise direction as viewed so as to have the drive edge 26 leading. A turned up arm 74 is attached by a screw 76 to the drive blade 24 to provide an operator manipulable handle for counteracting the spring 68 to permit unloading of the ribbon spool.

Also forming part of the three-armed pivot 66 is the bar 78 that includes an arm 80 and an arm 82 which is connected to the arm 64 at pin 84. The pin 67 about which the three-armed pivot 66 rotates is mounted to the carrier by a bracket at tabs 86 (only one is visible in FIG. 3) which extend from a bracket 88 that is mounted to the platform 51.

By alternately pulling on the arms 80 and 82 using respective cables 90 and 92 which wrap around corresponding pulleys 96 and 98, an arc of a circle centered at pin 67 is traced in a reciprocating motion. This motion approximates the desired linear reciprocating motion of axis 25 indicated by arrows in FIG. 1. The actuation of the cables 90 and 92 may be achieved by various known means such as solenoids (not shown). It should be appreciated that a solenoid mounted on the carrier 50 could be connected to directly actuate the arms 80 or 82. By changing the drive stroke, for example, by extending or shortening the arms 80 and 82, it is possible to adjust the advance increment for the ribbon 14.

Figure 2:
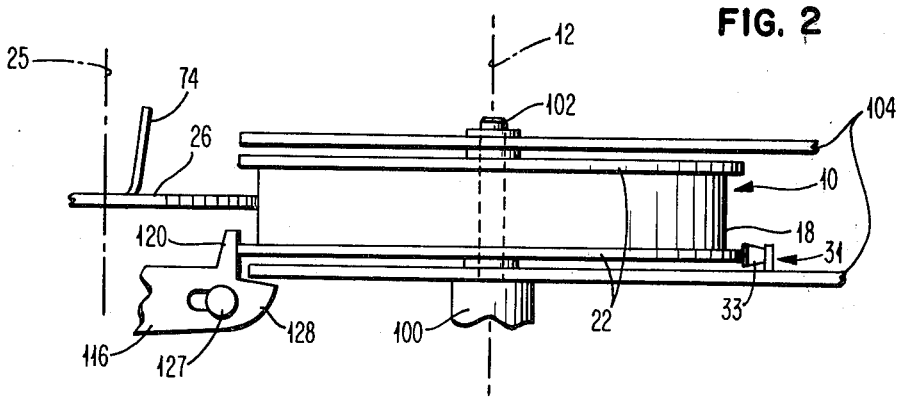
FIG. 2 is a left side elevational view emphasizing the positioning of the drive blade between the flanges of the takeup reel.

As can be seen best in FIGS. 1 and 2, the geometry of the drive configuration is such that the drive motion causes a jamming action between the drive blade 24 and the outer circumference 18 of the ribbon cylinder 20, since the resistance of the ribbon reel 10 to advance direction motion tends to rotate the drive edge 26 to "bite in" to the ribbon 14 (i.e. as viewed in FIG. 1, the blade 24 is forced in the clockwise direction by the resistance of reel 10 when the axis 25 is moved to the right).

Returning to FIG. 3, a support 100 extends from the platform 51 and includes a pin 102 that is spaced from the axis 25 (see FIGS. 1 and 2) and serves to define the axis 12 for the takeup reel 10 which is received thereon. As is seen best in FIG. 2, the pin 102 extends through the center of the takeup reel 10 which may for convenience be supported in a housing 104. The housing 104 permits convenient mounting of the brake 33.

Referring to FIG. 4, a special latch 110 is provided, according to an aspect of the invention, to hold the drive blade 24 in a withdrawn position (shown in FIG. 3) to facilitate changing of the takeup reel 10. A bracket 112 is mounted to platform 51 for sliding adjustment by screws 114. An upturned section of the bracket 112 supports two latch members 116 and 118 that are pivotable to move between a first position with tabs 120 and 122 in the path of the drive blade 24 and a second position out of the path of the drive blade 24.

When the operator withdraws the drive blade 24 by manipulating the arm 74 (FIG. 2), the latch 110 is tipped from the second position to the first by interaction at the upper latch member surfaces 124. A tab 126 engages the drive blade 24 and limits withdrawal thereof while when the latch bar 118, which is slidably mounted (by pins 127) to the bracket 112, reaches an end of travel. The sliding motion of the latch bar 118 moves the tab 122 to a shifted position (shown in phantom) to slow down the drive blade 24 for capture after operator release so that excessive momentum is not built up under acceleration by the spring 68. To facilitate loading of the takeup reel further, a tab on latch bar 116 extends to engage the housing 104 (or, alternatively, the takeup reel 10) which causes a rotation from the first to the second position releasing the drive blade 24. Hence, when the takeup reel 10 is loaded, the drive blade is automatically released and is driven against the outer circumference 18 by the urging of the spring 68 to be ready to advance the ribbon 14.

The invention has been described in detail with reference to a presently preferred implementation thereof. It will be appreciated, however, that variations and modifications are possible within the scope and spirit of the claimed invention. For example, a reciprocating drive action may be achieved with a blade departing somewhat from the involute shape. Also, the ribbon or tape that is advanced need not be of woven material. Indeed, the drive arrangement described has been used to advance a plastic lift-off ribbon for a printer.

I claim:

1. Tape drive apparatus for advancing a tape from a supply, said tape drive apparatus comprising:

a tape reel mounted for rotation about a reel axis, said reel defining a wrap plane for tape accumulation as a cylinder of overlaid convolutions having an outer circumference;

an elongate drive blade, mounted to move generally in said wrap plane, and having a drive edge that is asymmetrically textured to have a higher tendency to slip in a first longitudinal direction than in the opposite longitudinal direction;

means for urging said drive edge against said outer circumference of said tape cylinder;

means for oscillating said drive blade whereby said drive edge imparts increments of motion to said tape reel in the direction corresponding to the lower tendency for drive edge slippage.

2. A tape drive apparatus according to claim 1 wherein said tape reel has first and second spaced flanges perpendicular to said reel axis between which said tape cylinder is accumulated.

3. A tape drive apparatus according to claim 2 wherein said blade is mounted to move in a plane intermediate said first and second flanges.

4. A tape drive apparatus according to claims 1 or 3 wherein said drive blade is pivoted to rotate about a blade pivot axis parallel to said reel axis and said drive edge has the shape of an involute for a generating circle centered at said blade pivot axis, whereby said drive edge strikes said outer tape circumference tangentially over a range of tape cylinder diameters.

5. A tape drive apparatus according to claim 1 wherein said drive edge is textured with sawtooth-like serrations.

6. A tape drive apparatus according to claim 4 wherein said drive edge is textured with sawtooth-like serrations.

7. A tape drive apparatus according to claim 1 wherein said oscillating means includes a drive member, to which said drive blade is pivotally mounted, which drive member is mounted to pivot about an axis that is generally perpendicular to said wrap plane, and means for vibrating said drive member over a narrow arc whereby a back-and-forth motion is transmitted to said drive blade.

8. A tape drive apparatus according to claim 4 wherein a brake acts on said tape reel to prevent motion opposite the forward direction.

9. A tape drive apparatus for advancing a tape from a supply, said tape drive apparatus comprising:

a tape reel removeably mounted for rotation about a reel axis to accumulate tape as a cylinder of overlaid convolutions having an outer circumference;

an elongate drive blade, mounted to move in a wrap plane generally perpendicular to said reel axis and intersecting said cylinder, said drive blade having a drive edge that is asymmetrically serrated to have a higher tendency to slip in a first longitudinal direction than in the opposite longitudinal direction, said drive edge having the contour of an involute for a generating circle;

means for urging said drive edge against said outer circumference of said tape cylinder;

means for reciprocating said drive blade in said wrap plane whereby said drive edge imparts increments of motion of said tape reel in a forward direction corresponding to the lower tendency for drive edge slippage.

10. A tape drive apparatus according to claim 9 wherein said drive blade is mounted to pivot about an axis corresponding to the center of said generating circle and said reciprocating means moves said drive blade in directions generally perpendicular to a line extending from said reel axis to be tangent to said generating circle.

11. A tape drive apparatus according to claim 9 or 10 wherein a displaceable latch is provided for holding said drive blade away from said tape reel to facilitate replacement of said reel.

12. A tape drive apparatus according to claim 11 wherein said latch is positioned to be released by mounting of a tape reel.

13. For use in a printer, a ribbon advancing mechanism comprising:

a reel for receiving said ribbon;

means for releasably mounting said reel for rotation about a reel axis;

a drive blade mounted on a drive bar to rotate about a blade pivot axis generally parallel to said reel axis, said drive blade having a drive edge in the shape of an involute for a generating circle centered at said blade pivot axis, said drive bar being mounted to rotate about an axis parallel to and spaced from said blade pivot axis;

biasing means for urging said drive blade about said blade pivot axis with said drive edge forward to engage the outer periphery of ribbon accumulated at said reel, said drive edge having serrations establishing a gripping direction and an opposite slip direction;

means for oscillating said drive bar whereby motion is transmitted to said reel through said drive blade during portions of oscillations corresponding to motion of said drive edge in said gripping direction.

14. A ribbon advancing mechanism according to claim 13 wherein said reel includes flanges perpendicular to said reel axis for confining accumulated ribbon.

15. A ribbon advancing mechanism according to claim 13 wherein said serrations are asymmetrical teeth on said drive edge.

* * * * *